US008712269B2

(12) United States Patent
Yoshinaga

(10) Patent No.: US 8,712,269 B2
(45) Date of Patent: Apr. 29, 2014

(54) IMAGE FORMING APPARATUS CAPABLE OF TIMELY STARTING DIFFERENT IMAGE FORMATION MODE

(75) Inventor: Hiroshi Yoshinaga, Chiba (JP)

(73) Assignee: Ricoh Company, Ltd., Tokyo (JP)

( * ) Notice: Subject to any disclaimer, the term of this patent is extended or adjusted under 35 U.S.C. 154(b) by 406 days.

(21) Appl. No.: 13/110,133

(22) Filed: May 18, 2011

(65) Prior Publication Data

US 2011/0286758 A1 Nov. 24, 2011

(30) Foreign Application Priority Data

May 19, 2010 (JP) ..... 2010-115404

(51) Int. Cl.
*G03G 15/20* (2006.01)

(52) U.S. Cl.
USPC ..... 399/69

(58) Field of Classification Search
USPC ..... 399/69, 341
See application file for complete search history.

(56) References Cited

U.S. PATENT DOCUMENTS

| | | | |
|---|---|---|---|
| 7,546,049 | B2 | 6/2009 | Ehara et al. |
| 2002/0018663 | A1 | 2/2002 | Furukawa et al. |
| 2002/0067936 | A1 | 6/2002 | Yasui et al. |
| 2003/0000933 | A1 | 1/2003 | Yoshinaga et al. |
| 2003/0007813 | A1 | 1/2003 | Yasui et al. |
| 2003/0016963 | A1 | 1/2003 | Yoshinaga et al. |
| 2003/0113127 | A1 * | 6/2003 | Takane ..... 399/45 |
| 2003/0206758 | A1 | 11/2003 | Yasui et al. |
| 2003/0215271 | A1 | 11/2003 | Yoshinaga et al. |
| 2005/0025539 | A1 | 2/2005 | Yoshinaga |
| 2005/0095043 | A1 | 5/2005 | Yoshinaga et al. |
| 2006/0165443 | A1 | 7/2006 | Yoshinaga et al. |
| 2006/0165448 | A1 | 7/2006 | Yoshinaga |
| 2006/0257183 | A1 | 11/2006 | Ehara et al. |
| 2008/0063443 | A1 | 3/2008 | Yoshinaga et al. |
| 2008/0253789 | A1 | 10/2008 | Yoshinaga et al. |
| 2008/0317532 | A1 | 12/2008 | Ehara et al. |
| 2009/0067902 | A1 | 3/2009 | Yoshinaga et al. |

(Continued)

FOREIGN PATENT DOCUMENTS

| | | |
|---|---|---|
| JP | 63-155168 | 6/1988 |
| JP | 4-264578 | 9/1992 |

(Continued)

OTHER PUBLICATIONS

Japanese Office Action issued Oct. 8, 2013, in Japan Patent Application No. 2010-115404.

*Primary Examiner* — Billy Lactaoen
(74) *Attorney, Agent, or Firm* — Oblon, Spivak, McClelland, Maier & Neustadt, L.L.P.

(57) ABSTRACT

An image forming apparatus includes a thermal fixing unit having a fixing member heated or cooled at multiple levels of the target fixing temperature in accordance with prescribed different image formation conditions, and a pressing member pressing against the fixing member to form a fixing nip thereon. A controller is provided to permit an image formation device to start image formation when temperature of the fixing member decreases to a level equal to or less than a prescribed image formation permissible temperature from temperature higher than one of the multiple levels of the target fixing temperature. The prescribed image formation permissible temperature is calculated by adding a prescribed adjustment value determined in accordance with a type of an image to be outputted to one of the multiple levels of the target fixing temperature.

3 Claims, 6 Drawing Sheets

(56) References Cited

U.S. PATENT DOCUMENTS

| | | | |
|---|---|---|---|
| 2009/0123202 | A1 | 5/2009 | Yoshinaga et al. |
| 2009/0148204 | A1 | 6/2009 | Yoshinaga et al. |
| 2009/0169232 | A1 | 7/2009 | Kunii et al. |
| 2009/0245865 | A1 | 10/2009 | Shinshi et al. |
| 2010/0092220 | A1 | 4/2010 | Hasegawa et al. |
| 2010/0092221 | A1 | 4/2010 | Shinshi et al. |
| 2010/0202809 | A1 | 8/2010 | Shinshi et al. |
| 2010/0290822 | A1 | 11/2010 | Hasegawa et al. |
| 2011/0026988 | A1 | 2/2011 | Yoshikawa et al. |
| 2011/0044734 | A1 | 2/2011 | Shimokawa et al. |
| 2011/0051201 | A1 | 3/2011 | Hashimoto et al. |
| 2011/0052237 | A1 | 3/2011 | Yoshikawa et al. |
| 2011/0052282 | A1 | 3/2011 | Shinshi et al. |
| 2011/0058862 | A1 | 3/2011 | Yamaguchi et al. |
| 2011/0058863 | A1 | 3/2011 | Shinshi et al. |
| 2011/0058864 | A1 | 3/2011 | Fujimoto et al. |
| 2011/0058866 | A1 | 3/2011 | Ishii et al. |
| 2011/0064437 | A1 | 3/2011 | Yamashina et al. |
| 2011/0064443 | A1 | 3/2011 | Iwaya et al. |
| 2011/0085832 | A1 | 4/2011 | Hasegawa et al. |

FOREIGN PATENT DOCUMENTS

| | | | | | |
|---|---|---|---|---|---|
| JP | 8-16032 | | | 1/1996 | |
| JP | 9-190107 | | | 7/1997 | |
| JP | 2000-181275 | | | 6/2000 | |
| JP | 3252602 | | | 11/2001 | |
| JP | 2002-40873 | | | 2/2002 | |
| JP | 2002-49272 | | | 2/2002 | |
| JP | 2002139950 | A | * | 5/2002 | ..... G03G 15/20 |
| JP | 2003-173103 | | | 6/2003 | |
| JP | 2009-181065 | | | 8/2009 | |

* cited by examiner

IMAGE FORMING APPARATUS CAPABLE OF TIMELY STARTING DIFFERENT IMAGE FORMATION MODE

CROSS REFERENCE TO RELATED APPLICATIONS

This application claims priority pursuant to 35 USC §119 to Japanese Patent Application No. 2010-115404, filed on May 19, 2010, the entire contents of which are hereby incorporated by reference herein.

BACKGROUND OF THE INVENTION

1. Field of the Invention

The present invention relates to an image forming apparatus, having an image formation device and a thermal fixer, and in particular to an image forming apparatus operable under different image formation conditions of various resolution levels and process velocities or the like.

2. Description of the Background Art

In various image forming apparatuses, such as copiers, printers, duplicators, etc., an image is borne on a recording medium, such as a transfer medium, a sheet like medium, etc., and is finally fixed onto a copying or printing sheet by a fixer. The fixer employs a pair of opposed rollers composed of a heating roller and a pressing roller that presses the recording medium against the heating roller to form a nip therebetween. The recording medium is pinched and conveyed through the nip, so that the image not yet fixed is fixed by heat generated by the heating roller as shown in FIG. 3.

Recently, as a printer increases its resolution, a high resolution mode, such as a 1,200 dpi (dot per inch) mode, etc., is demanded.

However, when the resolution is increased from 600 dpi to 1,200 dpi for example, a number of rotations of a polygon mirror, which is provided in a laser scanning system of a laser beam printer, generally needs to be increased to be doubled to more than 30,000 rpm (revolutions per minute), etc., for example, thereby posing technical and manufacturing cost problems.

To resolve such inconvenience, a conventional printer employs a process velocity changing system and changes a resolution level and a process velocity (equivalent to a conveyance velocity, a line velocity of a recording medium, and an image formation velocity or the like). For example, a conventional printer capable of outputting 22 sheets per minute with 600 dpi at a process velocity of 120 mm/sec halves the process velocity down to half to output 11 sheets per minute with 1,200 dpi.

In such a printer, since the number of rotations of a polygon mirror is kept constant regardless of the resolution, technical and manufacturing cost problems do not occur. However, when the line velocity is changed between 120 mm/sec and 60 mm/sec, an optimum value of a process condition for electrophotographic process condition changes, and accordingly a target fixing temperature of a fixer needs to be changed as well.

For example, when the line velocity is 120 mm/sec, the target fixing temperature is to be increased even when handling the same sheet size. By contrast, when it is 60 mm/sec, the target fixing temperature is to be decreased.

Further, a ratio of color images to total outputs from the image forming apparatus is increasing these days and glossiness of a fixed toner image is one of measures for evaluating the color image. An image having a low glossiness (generally equal to or less than 15%) is popular in typical business documents, whereas that having a high glossiness (equal to or more than 20%) is popular for photographs, catalogs, and brochures printing or the like as trend. Thus, depending on the usage of the output image, a prescribed image forming apparatus is selectively used.

Such a high glossiness image can be formed by increasing the target fixing temperature with an increased amount of toner attracted to a sheet. However, when such conditions are maintained, an ordinary image not requiring such high glossiness is undesirably and excessively supplied with toner and heat in the fixer in ecology and energy saving view points. Accordingly, the processing conditions need to be changed in accordance with the type of an image to be formed, while the target fixing temperature needs to be changed to form and fix an image with the minimum amount of both toner particles and heat.

However, as described above, when an image formation condition or a line velocity is changed, a target fixing temperature needs to be changed to be optimum.

As a result, since a passage time for a sheet to pass through a fixing nip increases when the image formation velocity is decreased, calorie is excessively applied to both a toner image and the recording medium itself bearing the toner image thereon. When temperature in the nip of the fixer is maintained to be high, hot offset likely occurs or an amount of curl of the recording medium increases. Accordingly, a surface temperature of the fixer needs to be decreased to a prescribed level before executing such a fixing process to avoid occurrence of such abnormalities.

However, since a calorific capacity of the fixer of FIG. 3 is relatively large, a certain waiting time is needed to decrease temperature of the fixer from high to low levels when the image formation line velocity is changed lower. It is also true when an image formation condition is changed even maintaining the image formation line velocity.

Japanese Patent Application Laid Open No. 07-306609 (JP-H07-306609-A) attempts to resolve such a problem and employs a system of forcibly cooling a heating roller using a blower module.

Specifically, the system of JP-07-306609-A appropriately changes a force of a blower when an image formation line velocity, and accordingly a target fixing temperature are changed. In particular, it increases the force when cooling thereof so as to minimize the waiting time. Japanese Patent Application Laid Open No. 2000-181275 (JP-2000-181275-A) also attempts to resolve the problem and additionally employs a controller to control a blowing force of a blower module for the same purpose.

However, in both of the above-described prior arts, since the cooling system cools the fixer down to a prescribed setting temperature, (excessive?) calorie of thermal storage is necessarily wasted in the fixer. In addition, since the blowing force of the blower is increased, and accordingly more energy is consumed in driving the cooling system, an image forming apparatus does not effectively save energy.

SUMMARY OF THE PRESENT INVENTION

Accordingly, an object of the present invention is to provide a novel image forming apparatus that comprises an image formation device that forms a toner image to be transferred and fused later onto a recording medium under prescribed different multiple image formation conditions, a thermal fixing unit including a fixing member (heated or cooled at least two levels of the target fixing temperature in accordance with the at least two prescribed different image formation conditions) and a pressing member pressing against the fixing member to form a fixing nip thereon to fix the toner image onto a recording medium by conveying the recording medium through the fixing nip. A determiner is provided to determine if temperature of the fixing member is higher than one of the multiple levels of the target fixing temperature when an image output is requested and the image formation device becomes ready to operate in response thereto after start up control is completed. A controller is provided to permit the image formation device to start image formation when the temperature of the fixing member decreases to a level equal to or less than a prescribed image formation permissible temperature from temperature higher than one of the multiple levels of the target fixing temperature. The prescribed image formation permissible temperature is calculated by adding a prescribed adjustment value determined in accordance with a type of an image to be outputted to one of the multiple levels of the target fixing temperature.

In another aspect, a controller permits the image formation device to start image formation all of when one of the plural image formation conditions is changed to the other, when the first target fixing temperature is changed to the second target fixing temperature lower than the first target fixing temperature, and when temperature of the fixing member becomes less than a prescribed image formation permissible temperature. The prescribed image formation permissible temperature is calculated by adding a prescribed adjustment value determined in accordance with a type of an image to be outputted to the second target fixing temperature.

In yet another aspect, the prescribed adjustment value is greater when the image to be outputted does not need glossiness than when it needs the glossiness.

In yet another aspect, the prescribed adjustment value is determined in accordance with a number of the images to be outputted.

In yet another aspect, the prescribed adjustment value is determined in accordance with an amount of toner particles attracted to the image to be outputted.

In yet another aspect, the controller permits the image formation device to start image formation all of when the first target fixing temperature is changed to the second target fixing temperature, and when a previous job is completed under a previous image formation condition designated previously and the next job becomes available, and when a prescribed elapsing time has elapsed after the next job becomes available.

In yet another aspect, the prescribed elapsing time is shorter when the image to be outputted does not need glossiness than when it needs the glossiness.

In yet another aspect, the controller permits the image formation device to start image formation before the prescribed time has elapsed after the image formation becomes available, all of when one of the multiple image formation conditions is changed to the other, when the first target fixing temperature is changed to the second target fixing temperature, and when temperature of the fixing member is equal to or less than a prescribed image formation permissible level higher than the second target fixing temperature by a prescribed adjustment value.

In yet another aspect, an image forming apparatus comprises a thermal fixing unit including a fixing member (heated or cooled at least two levels of the target fixing temperature in accordance with the at least two prescribed different image formation conditions) and a pressing member pressing against the fixing member to form a fixing nip thereon. The thermal fixing unit fixes the toner image onto a recording medium by conveying the recording medium through the fixing nip. One of the fixing member and the pressing member is composed of an endless belt wound by plural rollers.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

PREFERRED EMBODIMENTS OF THE PRESENT INVENTION

Figure 1:
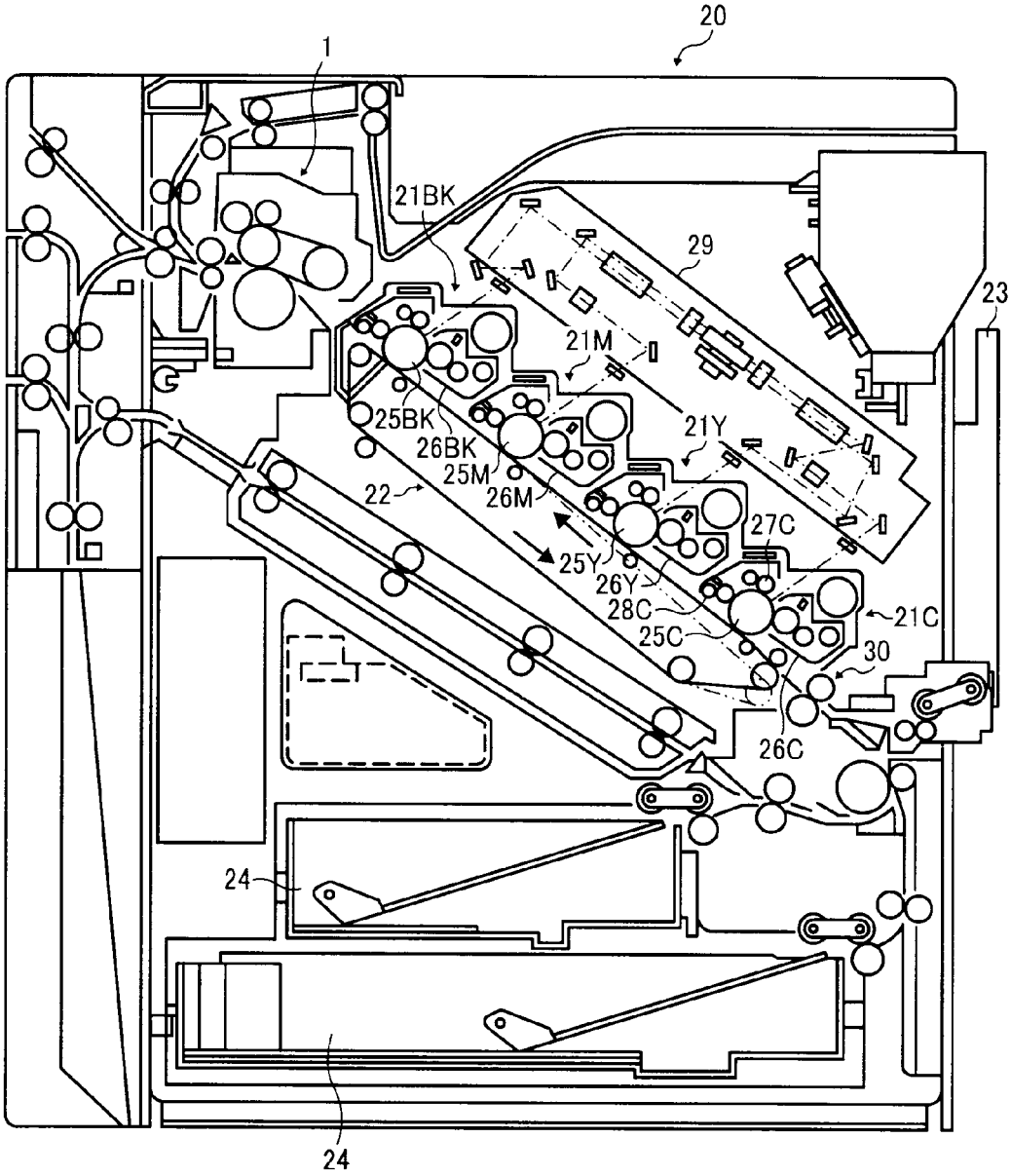
FIG. 1 is a cross sectional view illustrating an exemplary image forming apparatus according to one embodiment of the present invention.

Referring now to the drawings, wherein like reference numerals designate identical or corresponding parts throughout several views, in particular in FIG. 1, an image forming apparatus 20 is used as a full-color image forming apparatus and a printer capable of forming a full-color image, and a fax capable of image processing in the same manner as the above-described devices based on an image signal received. The image forming apparatus can also serve as a monochrome image forming apparatus.

Specifically, the image forming apparatus 20 includes image forming devices 21C to 21Bk for forming images of respective different colors in accordance with an image of an original document, transfer devices 22 provided being opposed to the respective image forming devices 21C to 21Bk, and a manual sheet feeding tray 23 for supplying various sheet medium Ps to transfer stations, in which the transfer devices 22 oppose the respective image forming devices 21C to 21Bk. Also provided are a sheet feeding cassette 24, a registration rollers 30 for supplying the sheet medium P conveyed by the manual sheet feeding tray 23 or the sheet feeding cassette 24 synchronizing with image formation on the respective image forming devices 21C to 21Bk, and a fixer for fixing the sheet medium P having been subjected to the transfer process in the transfer stations. The transfer device 22 obliquely extends to decrease an occupation space thereof in the image forming apparatus in the horizontal direction.

The image forming apparatus 20 accepts all of plain paper, generally used in copying, a 90Kiro-sheet, such as an OHP (over head projector sheet) sheet, a normal card, a postcard, etc., a heavy paper having a unit weight of more than about 100 g/m$^2$, and a special sheet, such as an envelope, etc., having greater calorific capacity than a sheet, as the sheet medium P.

When a duplication image formation mode is chosen, a sheet medium P is ejected from the fixer 1 after having been subjected to first surface fixation, and is conveyed to and passes through both of a duplication inversion unit 31 and a duplication conveyance unit 32. The sheet medium P is further conveyed to the registration rollers 30 again to be subjected to second surface image formation.

Since configurations of the image forming devices 21C to 21BK are substantially the same except to color of toner used, only the image forming device 21C is herein below described in detail.

The image forming device 23C has a known configuration including a photoconductive drum 25C for bearing a latent image thereon. A charger 27C, a developing device 26C, and a cleaner 28C are also provided along a rotation direction A of the photoconductive drum 25C in this order and the photoconductive drum 25C receives an exposure light from an exposure 29 between the charger 27C and the developing device 26C. Then, an image formation process of charging, exposing, and developing is executed on the photoconductive drum 25C under prescribed conditions and a toner image of cyan color is formed. Subsequently, the cyan toner image is transferred onto a sheet at the transfer station. The, the photoconductive drum 25C is subjected to cleaning in a cleaning step. The bearer bearing such a latent image can be belt type rather than the drum type as above.

The photoconductive drums 25C to 25BK are rotated and driven by driving motors, not shown, clockwise in FIG. 1, and surfaces thereof are uniformly charged at positions where chargers are attached in charging steps. Subsequently, the surface of the photoconductive drums 25C to 25BK reach light emission positions where the exposure light reaches from the exposure 29 thereto, so that latent images are formed thereon in accordance with respective colors during am exposure step.

Subsequently, the surface of the photoconductive drums 25C to 25BK reach positions opposed to the developing devices attached and are developed there to be toner images of respective colors in developing steps. Then, the surface of the photoconductive drums 25C to 25BK reach positions opposed to the transfer belt and bias roller of the transfer device 22 and respective color toner images of superimposed one after another onto a sheet medium P on a transfer belt conveyed thereto to be a color toner image in transfer steps. At that moment, a small amount of toner particles remains on each of the photoconductive drums 25C to 25BK not being transferred onto the sheet medium P.

Subsequently, the surface of the photoconductive drums 25C to 25BK reach positions opposed to the cleaners, and the small amount of toner particles remains on each of the photoconductive drums 25C to 25BK not being transferred onto the sheet medium P are mechanically collected by the cleaning blade in cleaning steps. Finely, the surface of the photoconductive drums 25C to 25BK reach positions opposed to charge removers, not shown, and potential remaining on each of the photoconductive drums 25C to 25BK is removed. Hence, series of image formation processes executed on the respective photoconductive drums 25C to 25BK are completed.

The sheet medium P conveyed to the position of the transfer nip is conveys from the sheet feeding cassette 34 as a sheet feeder provided in the lower section of the image forming apparatus 20 via the sheet feeding roller or the registration rollers 30 and similar. For example, the sheet feeding cassette 24 accommodates a stack of multiple sheet mediums P, such as a transfer sheet, etc. Thus, when the sheet feeding roller is driven and rotated, the top most sheet medium P is fed toward a roller gap of the registration rollers. Subsequently, the sheet medium P conveyed to the registration rollers 30 temporarily stops at its roller nip thereof, because the registration rollers are stopping, and is then conveyed toward a transfer nip as the registration rollers are driven and rotated synchronizing with image formations executed on the respective image forming devices 21C to 21BK (i.e., toner image formations). Hence, a desired color image is transferred onto the sheet medium P.

Then, the sheet medium P with the color image transferred there onto is conveyed to a position of the fixer 1, where a fixing nip is created by pressing a pressing member heated to a prescribed level against the fixing member. Thus, by passing through the fixing nip receiving heat and pressure, the color toner image transferred onto the sheet medium P is fixed thereonto. The sheet medium P having been subjected to the image fixation is then ejected outside the image forming apparatus. In this way, series of image formation processes are completed in the image forming apparatus.

Now, an exemplary belt type fixer applied to the image forming apparatus 20 is described with reference to FIG. 2. As shown, the fixer 1 includes an endless fixing belt 2 for fixing toner borne on the sheet medium P by contacting thereto, a pressing roller 3, and a fixing roller 4 collectively stretching and winding the fixing belt 2, and a pressing roller 5 for creating a fixing nip by pressing the fixing roller 4 via the fixing belt 2. Also provided are heaters 6 and 7 in the heating and pressing rollers 3 and 5, respectively, and a temperature detector provided opposed to the fixing belt 2 and the pressing roller 5 for detecting temperature, respectively.

The fixing belt 2 is provided with a prescribed tension, from inside thereof, by a tension roller that is biased by an elastic member, not shown.

The fixing roller 4 includes a metal core 9 and a heat resistant porous elastic layer 10 overlying the metal core 9. The fixing roller 4 is biased by an elastic member, such as a spring, etc., not shown, toward the pressing roller 5 to press there against. Numeral 12 denotes a guide for guiding the sheet medium P to be subjected to fixation to the fixing nip.

Calorific capacity of the heater 6 is greater that that of heater 7 in the rollers 3 and 5.

Because, the calorific capacity of the fixing belt 2 is smaller than that of the pressing roller 5, and because a start up time can be minimized if the surface of the pressing roller 5 is heated by not only the heater 7 but also the surface of the fixing belt 2 when cold start is performed. Thus, according to one embodiment of this configuration, power of the heaters 6 and 7 are 1100 [W] and 200 [W] when 100[V] is applied.

A fixing separation pick 11 is provided downstream of the fixing nip with its leading end pressing against an outer circumferential surface of the fixing belt 2. Thus, even if it sticks to the outer circumferential surface of the fixing belt 2, the sheet medium P is separated therefrom without winding up around the fixing belt 2, because the fixing separation pick invades in between the outer circumferential surface of the fixing belt 2 and the sheet medium P.

Further, silicone oil is preferably coated onto the surface of the fixing belt 2 to improve releasability of the toner from the fixing belt 2 using a very small quantity coating roller 121 and similar. The very small quantity roller 121 is made of sponge state foam impregnated with silicon oil overlying around the metal core with one or two sheets of translucent films having fine porous on the outer circumferential surface. Thus, a small amount of silicon oil emerges from the foam through the translucent films and is coated onto an opposed member. At that moment, a surface film of the above-described very small quantity coating roller 121 is made of fine releasable material to avoid toner from firmly sticking to the surface of the very small quantity coating roller 121 when paper jam occurs and the toner is attracted thereto. That is, if toner from firmly sticking to the surface of the very small quantity coating roller 121, the fine holes for oil passage are closed and are impossible to be coated. Thus, the surface layer film preferably employs a Gore-Tex™ film to prioritize the releasability.

Figure 2:
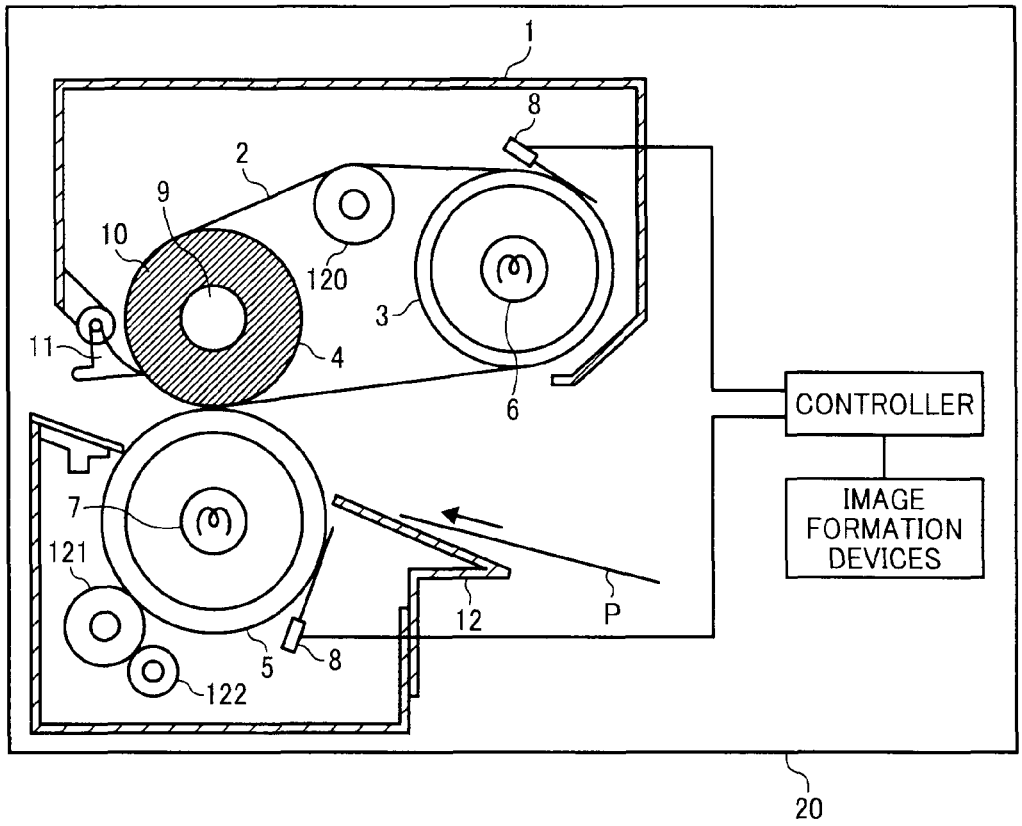
FIG. 2 is a cross sectional view illustrating an exemplary belt type fixer applied to the image forming apparatus according to one embodiment of the present invention.

As shown by the fixer of FIG. 2, among a pair of rollers (i.e., heating and pressing rollers 3 and 4), the heating roller 3 opposed to the pressing roller 5 and cooperatively drives the fixing roller 4 with the fixing roller 4 includes a heat source (i.e., a heater 6) to heat the fixing belt 2 from a rear side surface thereof. The pressing roller 5 is also provided with a heat source (a heater 7) to heat the fixing belt 2. Since a cubic volume and accordingly calorific capacity of the fixing belt 2 is smaller than that of each of the heating and pressing rollers 3 and 5, temperature of the fixing belt 2 can more quickly increases than a system only employing the above-described heating and pressing rollers 3 as an advantage. Further advantage is quick increase in temperature both on the front and rear side surfaces of the fixing belt 2 by providing the pressing roller 5 with the heat source.

Figure 3:
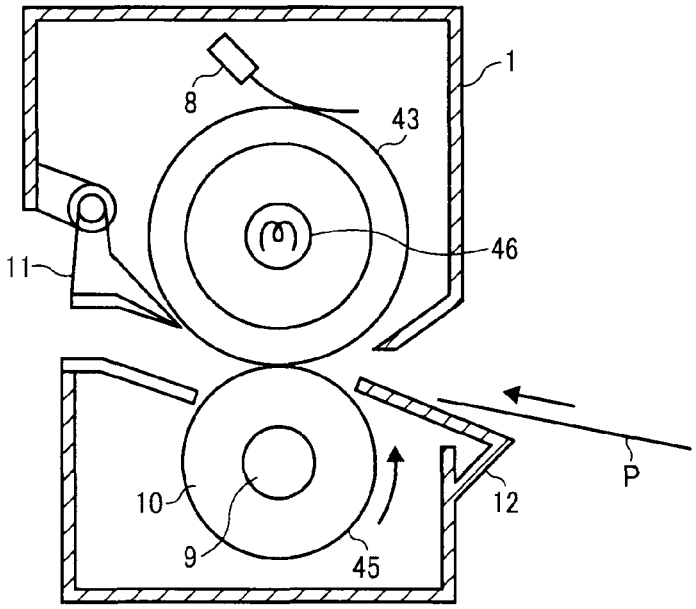
FIG. 3 is a cross sectional view illustrating an exemplary roller type fixer applied to the image forming apparatus according to one embodiment of the present invention.

Now, an exemplary roller type fixer applied to the image forming apparatus 10 is described with reference to FIG. 3. As shown, the fixer 1 fuses an unfixed image in a nip created between heating or fixing and pressing rollers 43 and 45 while conveying and pinching a sheet medium P there between with heat from the heating roller 43.

The heat roller 43 includes a metal core made of aluminum and an in conductive PFA having a thickness of about 20 micrometer overlying the metal core to exert a releasability of toner. A heater 46 is provided in the heat roller 43 while having calorific capacity about 1,200 [W] under application of 100[V].

The pressing roller 45 includes a metal core 9, a heat resistant porous elastic layer 10 made of foam silicone rubber which overlies the metal core, and a conductive PFA tube having a thickness of about 30 to 50 micrometer overlying the elastic layer 10. Further, a thermistor 8 is provided being opposed to the heat roller 43 as a temperature detection to detect temperature of the surface of the heat roller 43. The pressing roller 45 is biased toward the heat roller 43 to pressing thereagainst by an elastic member, such as a spring, not shown, top create a fixing nip thereon. Numeral 12 denotes a guide for guiding a sheet medium P to be subjected to fixation to the fixing nip.

The fixing separation pick 11 is positioned downstream of the fixing nip with its leading end pressing against the outer circumferential surface of the heat roller 43. Thus, even if it sticks to the outer circumferential surface of the heat roller 43, the sheet medium P is separated there from without winding around the heat roller 43, because the fixing separation pick 11 invades in between the outer circumferential surface of the heat roller 43 and the sheet medium P as the sheet medium P is conveyed.

Since a cubic volume and accordingly calorific capacity of the fixing belt 2 is smaller than that of the heating roller 43, temperature of the fixing belt 2 can quickly increases and decreases during a down reload as described later in detail as advantage. Thus, a fixer of a belt type is more suitable than that of a roller type when control temperature is to be quickly changed as in this embodiment.

The image forming apparatus 20 can employ multi resolutions, such as 600 and 1,200 dpi, and is enabled to choose one of them to form an image. The image forming apparatus 20 controls image formation of the image forming devices 21C to 21BK under conditions corresponding to the resolution. For example, in a 600 dpi mode, the image formation is controlled designating 120 mm/sec as an image formation line velocity in each of the image forming devices 21C to 21BK. Whereas in a 1,200 dpi mode, 60 mm/sec is designated as an image formation line velocity in each of them. Such image formation control is executed as to each of mechanisms provided in the image forming devices 21C to 21BK, and includes controlling of a process velocity, such as a rotation speed, etc., of each of the photoconductive drums 25C to 25BK. The image formation line velocity corresponds to a conveyance velocity of a sheet medium P and is equivalent to the rotation velocities of the photoconductive drums 25C to 25BK.

Further, when the image formation line velocity changes, a conveyance velocity of a sheet medium P correspondingly changes. Thus, a fixing member of the fixer 1 is heated or cooled to a prescribed target fixing temperature chosen among multi target fixing temperatures in accordance with an image formation condition (an image formation mode) designated in the image forming devices 21C to 21BK. For example, when a plain paper having basic weight of about 60 to 80 g/m$^2$ is used in a 600 dpi mode, 143 degree centigrade is assigned as a target fixing temperature (T1 as a first level). Whereas 118 degree centigrade is assigned as a target fixing temperature (T2 as a second level) in a 1,200 dpi mode. Such setting temperatures enable to obtain most stable fixing performance and glossiness in the respective line velocities for a sheet medium P having a thickness of from about 60 to 80 g/m$^2$.

Specifically, by appropriately designating a target fixing temperature, a toner image is precisely fixed onto a sheet medium P while avoiding the sheet medium P and the toner image from being excessively heated and curled and from deviating from an appropriate image glossiness level, even if an image formation condition, such as an image formation mode, etc., changes. The glossiness is measured by a glossiness scale?, such as GM-60 Model (with measurement angle of 60 deg manufactured by Minolta)

Figure 4:
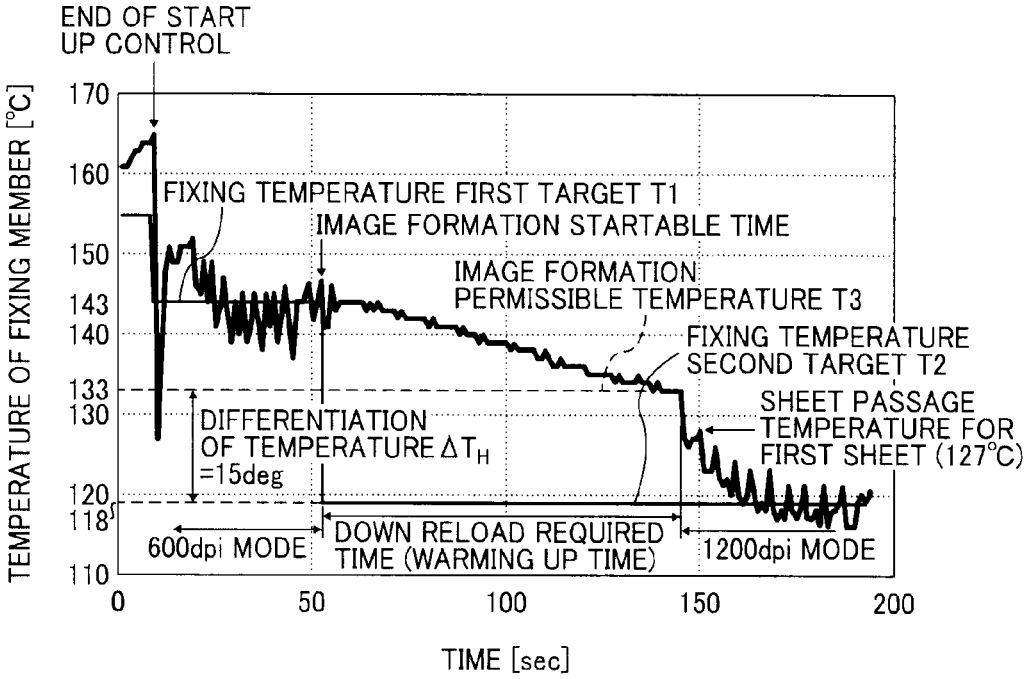
FIG. 4 illustrates an exemplary first temperature profile of a surface of a fixing member when a 600 mode is changed to a 1,200 dpi mode and images are consecutively outputted in an image forming apparatus according to one embodiment of the present invention.

When the first target fixing temperature T1 (e.g. 143 degree centigrade) is changed to a second target fixing temperature T1 (e.g. 118 degree centigrade) lower than the T1 in accordance with a change in image formation condition (i.e., an image formation mode) in the image forming devices 21C, 21Y, 21M, 21BK, e.g. from 600 to 1,200 dpi modes, the image forming apparatus 20 permits the image forming devices 21C to 21BK to start their image formation when an image formation permission temperature T3 (obtained as the sum of T2 and delta T) higher than the second target fixing temperature T2 by a prescribed differential temperature delta T as shown in FIG. 4.

Now, an exemplary profile of temperature detected by a thermistor 8 when an image formation mode in the image forming devices 21C, 21Y, 21M, and 21BK is changed from 600 to 1,200 dpi modes with line velocities of 60 mm/sec and 120 mm/sec, and images are successively outputted is described with reference to FIG. 4. Such an image formation mode is changed when a printer job is completed in the image forming apparatus 20 and the next printer job can be dealt (i.e., a time when image formation becomes available).

As shown, a first target fixing temperature T1 is 143 degree centigrade in a 600 dpi mode, and image formation in the 600 dpi mode is started when the fixer 1 is subjected to start up control and temperature of the fixing member (e.g. a fixing belt 2) is detected and reaches 143 degree centigrade plural times (e.g. at least twice) within a prescribed time after the start up control.

Further, a second target fixing temperature T2 is 118 degree centigrade in a 1,200 dpi mode, so that a difference between these two modes is 25 degree centigrade. Thus, heating of the fixing belt 2 by the heater 6 is stopped in fixer 1, and the fixing belt 2 is rotated without receiving any image formation processes until temperature thereof decreases down to a prescribed level as a waiting state (herein after referred to as a down reload). When the temperature of the fixing member (i.e., a heat roller 43) decreases down to 118 degree centigrade, image formation is to be started in the 1,200 dpi mode. In this embodiment, however, it is conditioned that the surface temperature of the fixing member decreases down to 133 degree centigrade when image formation is permitted, which is calculated by adding 15 degree centigrade of a differential temperature delta Th to the second target fixing temperature of 133 degree centigrade (i.e., 118+15=133 degree centigrade). Thus, the down reload needs about 90 second under this condition and causes an operator to necessarily wait for an output during such a time period.

Specifically, if image formation is successively executed otherwise at the first target fixing temperature of 143 degree centigrade used in the 600 dpi mode immediately after the image formation condition is changed to 1,200 dpi before the down reload time has elapsed, calorie applied to a toner image in the fixer 1 becomes excessive, and accordingly toner of an image is excessively fused, so that a hot offset image is outputted. Such an offset image emphasizes both of unevenness and glossiness of a surface of an image, but maintains fine a fixing performance.

It is popular to provide high glossiness to printing products, such as photographs, brochures, catalogues, etc. By contrast, it is popular to provide relatively low glossiness to business documents. Especially, the business documents and line images composed of line images such as text characters, etc., practically accept a low glossiness caused by the hot offset, as far as a fixing performance of a bar code image that requires a high resolution image is maintained. In such a situation, when calorie is excessively applied, the sheet medium P is largely curled in the fixer 1 as a problem. However, as far as temperature of the fixing belt 2 is less than an upper limit generating the curl in the sheet medium P, an image is practically outputted without problem.

Then, in the image forming apparatus 20 of this embodiment changes an amount of a prescribed differential temperature delta T in accordance with a type of an image to be outputted as described below.

Now, a first type image formation control is described. when the image forming apparatus 20 with the fixer 1 of FIG. 2 outputs an image onto a sheet medium P having a basic weight of about 60 to 80 g/m$^2$ at a line velocity of 60 mm/sec in a 1,200 dpi mode, and both of a prescribed fixing performance and a prescribed high glossiness are requested for the image, +15 degree centigrade is assigned as the differential temperature delta Th, so that the image formation permissible temperature of the fixing belt 2 is calculated by the below described formula and does not cause the hot offset;

$$T3=118+15=133 \text{ degree centigrade.}$$

Consequently, a waiting time period for down reload becomes 90 seconds as shown in FIG. 4.

Further, a second type image formation control is described.

When the business documents and line images only composed of line images, such as text characters, etc., but not requiring a prescribed high glossiness even requiring a prescribed fixing performance as needed in the printing products of the barcode image as described above, the differential temperature delta Th is increased than when the prescribed high glossiness and the prescribed fixing performance are needed, +25 degree centigrade is preferably assigned as delta T1 so that the image formation permission temperature of the fixing belt 2 does not cause curl in the sheet medium P. Because, it is already known that a temperature not causing curl in a sheet medium P having a thickness of about 60 to 80 g/ is equal or less than 145 degree centigrade when the image forming apparatus of FIG. 1 with the fixer of FIG. 2 outputs an image at the line velocity of 60 mm/sec in the 1,200 dpi mode.

At that moment, the following formula can be established for delta Th;

$$145-118=27 \text{ degree centigrade.}$$

Figure 5:
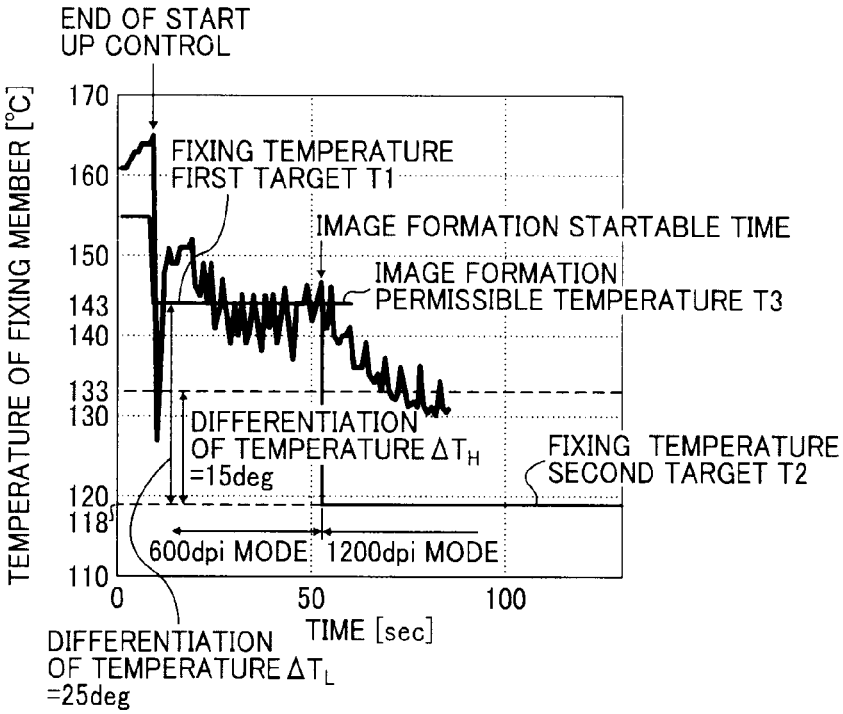
FIG. 5 illustrates an exemplary second temperature profile of a surface of a fixing member when an image formation mode is changed from 600 to 1,200 dpi modes and images are consecutively outputted in an image forming apparatus according to one embodiment of the present invention.

However, an allowance of 2 degree centigrade is provided for the purpose of safety considering a change in temperature of the fixing belt 2 and detection error of the thermistor 8. In such a situation, since the image formation permission temperature T3 is calculated by the formula (i.e., T3=118+25=143 degree centigrade), and the temperature of the fixing belt 2 becomes 143 degree centigrade when outputting of images in the 600 dpi mode is completed, a waiting time for the down reload is nothing (0 second), and accordingly, image formation can be immediately started in the 1,200 dpi mode as shown in FIG. 5.

Specifically, when an image requested to output is determined as the business documents, an image can be practically outputted without a quality problem even if image formation is immediately permitted just after image formation becomes available without lapsing about 90 second of the down reload. Accordingly, waist of energy can be minimized as much as possible.

By contrast, when an image requested to output is determined as the photograph image, the catalog, and the brochure printings or the like, a prescribed high quality image can be obtained via the down reload time period as shown in FIG. 4.

Figure 6:
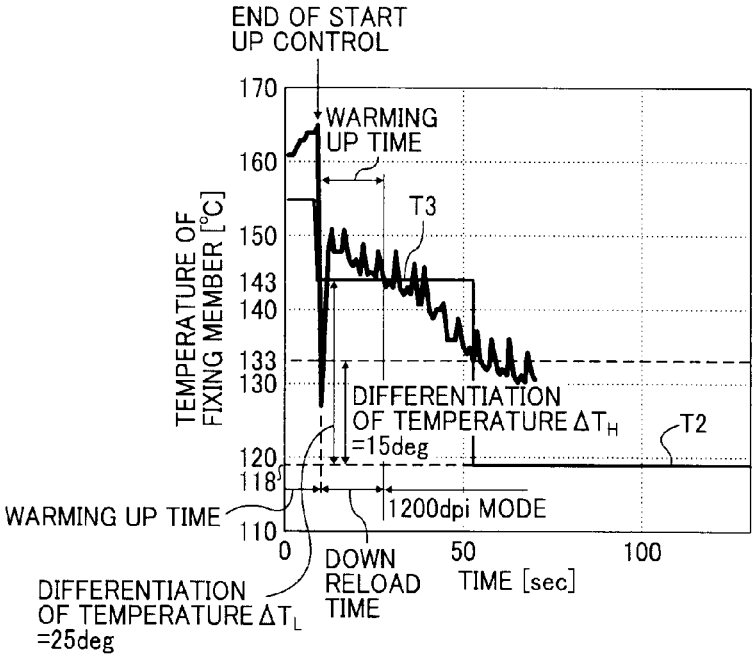
FIG. 6 illustrates an exemplary temperature profile of a surface of a fixing member when images are outputted in a 1,200 dpi image formation mode after apparatus start up control is completed in an image forming apparatus according to one embodiment of the present invention.

Further, when an image is outputted in the 1,200 dpi mode (at a line velocity of 60 mm/sec) after start up control of the fixer 1 is completed in the image forming apparatus 20 with the fixer 1 of FIG. 2 as shown in FIG. 6, and a prescribed fixing performance is needed by the prescribed high glossiness is not needed as in the second image type as above, 143 degree centigrade is assigned as the image formation permission temperature T3, and a waiting time of the down reload is 18 second.

Now, an exemplary modification of the image formation control is herein below described.

The image formation permission condition used when the target fixing temperature is changed from the higher to lower setting levels is, heretofore, temperature of the fixing belt (i.e., a fixing belt 2 and a heat roller 43), which is changed in accordance with an image type to be outputted.

However, the image formation permission condition can be a lapsing time changed in accordance with an image type to be outputted after image formation can be started (i.e., available). Specifically, the image formation devices 21C to 21BK are permitted to start image formation, all of when the T1 of the first target fixing temperature is changed to the T2 of the second target fixing temperature in response to a change in image formation condition for the image formation devices 21C to 21BK, when an image formation job is completed under a previous condition, and when a prescribed time, changed in accordance with a type of an image to be outputted, has elapsed from when the next image formation job becomes available (i.e., an image formation can be started). The prescribed time needed when the image to be outputted does not require the glossiness is shorter than that needed when the image requires the glossiness. Even in such a situation, a waiting time for image formation can be reduced saving energy as much as possible.

As another modification, the image formation permission condition is preferably switched between the above-described temperature of the fixing member (e.g. the fixing belt 2, the heat roller 43) and the above-described time period to elapse from when an image formation can be started (i.e., an image formation available time), each changed in accordance with an image type to be outputted (e.g. image information to form an image). The image formation permission condition is preferably switched based on image information transmitted from a printer control or in response to a change in designation of a user through the operation panel.

Further, the image formation permission condition may be determined as being the fast established condition between those when a prescribed time has elapsed from when image formation can be started and when a temperature of the fixing member decreases to equal or less than a prescribed image formation permission level T3. As a result, the user can obtain a prescribed high quality image in the shortest waiting time substantially avoiding an impact from the previous sequence.

Figure 7:
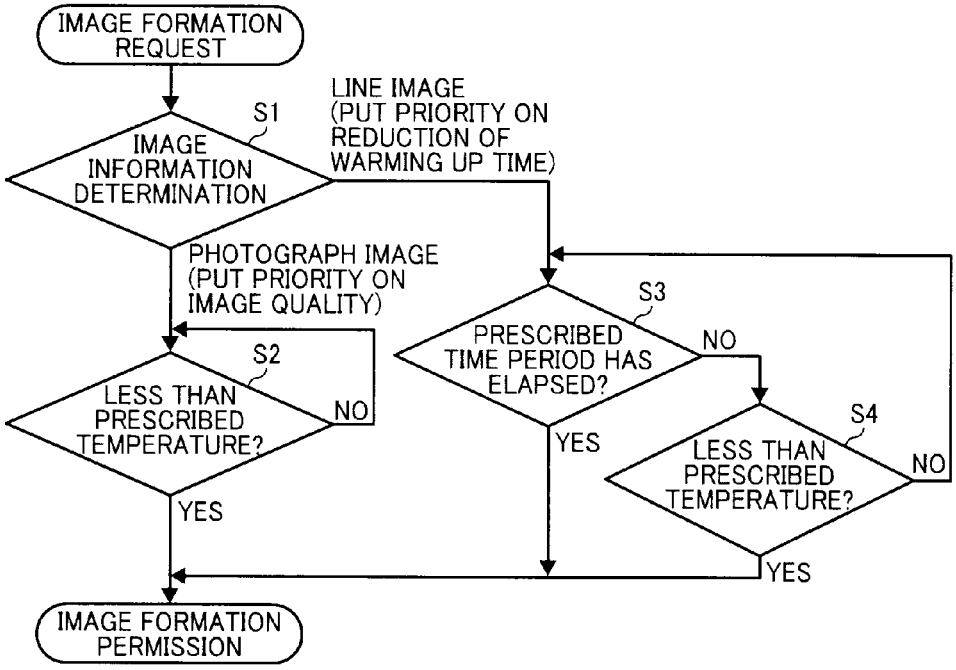
FIG. 7 illustrates an exemplary control sequence of image formation executed in an image forming apparatus according to one embodiment of the present invention.

Now, an exemplary sequence of image formation control executed in the image forming apparatus according to one embodiment of the present invention is described with reference to FIG. 7. In the sequence, it is at least premised that start up control is completed by a controller, provided in the image forming apparatus 20, for the fixer 1 and the image forming devices 21C to 21BK of the image forming apparatus 20 are ready to start image formation under control of the controller.

In step S1, when an image formation request (i.e., an image output request) is provided, the controller determines a type of an image to be outputted if it belongs to a photographic image that needs a prescribed glossiness and accordingly prioritizes image quality, or a line image that does not need a prescribed glossiness and prioritizes down reload time reduction.

When the image belongs to the photographic image, the down reload operation is executed till the temperature of the fixing member (i.e., the fixing belt 2 and the heat roller 43) decreases equal to or less than a prescribed image formation permission temperature T3 (i.e., the sum of a target fixing temperature and differential temperature delta Th (15 degree)), and permits the image formation when it is equal to or less than T3 in step S2.

By contrast, when the image belongs to the line image, the controller determines if a prescribed time period has elapsed from when image formation becomes available (i.e., the image formation can be started) in step 3. Such a prescribed time period for the line image is less than that needed for the photographic image. When, the prescribed time period has elapsed (Yes, in step S3), the image formation is permitted.

Whereas, when the prescribed time period has not elapsed (No, in step S3), the controller determines if the temperature of the fixing member is less than the prescribed image formation permission temperature T3 (i.e., the sum of a target fixing temperature and differential temperature delta T1 (25 degree)) in step S4. When the temperature of the fixing member is equal to or less than the prescribed image formation permission temperature T3 (Yes, in step S4), the image formation is permitted. However, when it is higher than the prescribed image formation permission temperature T3 (No, in step S4), the sequence returns to step S3 to determined if the prescribed time has been elapsed.

Consequently, with these steps S3 and S4, the image formation can be started within the shortest down reload time reducing a waiting time while saving energy as much as possible.

Figure 8:
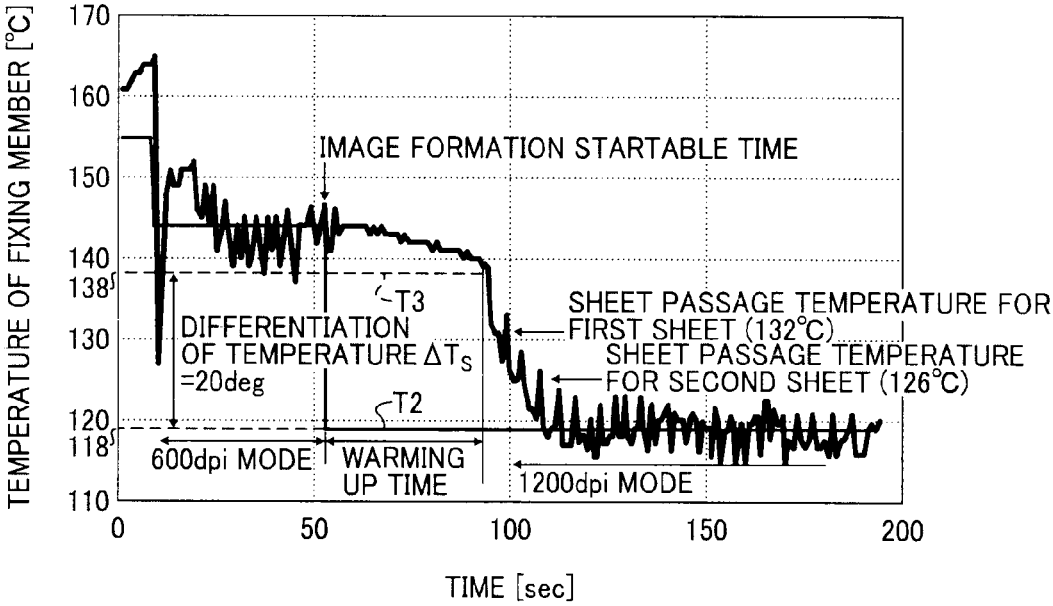
FIG. 8 illustrates an exemplary third temperature profile of a surface of a fixing member when an image formation mode is changed from 600 to 1,200 dpi modes and images are consecutively outputted in an image forming apparatus according to one embodiment of the present invention.
Figure 9:
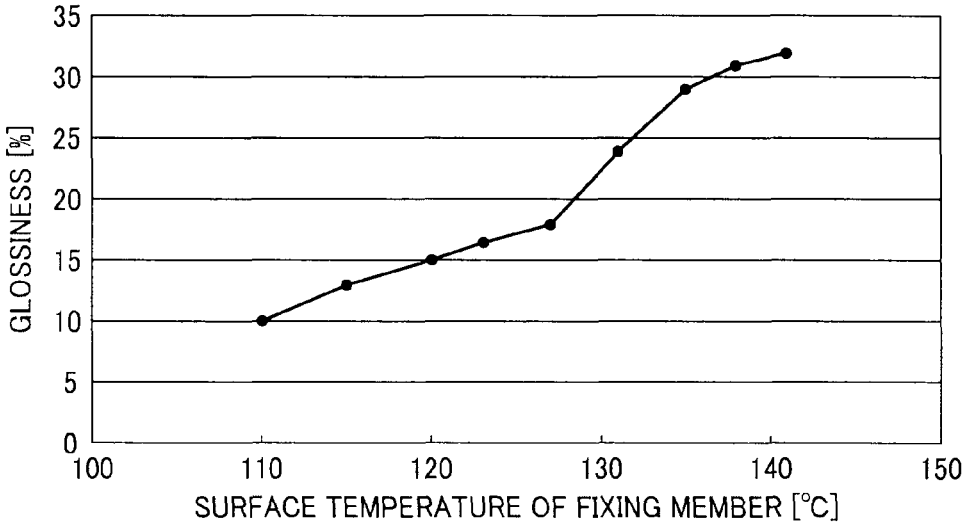
FIG. 9 illustrates an exemplary relation between surface temperature of a fixing member and image glossiness in an image forming apparatus according to one embodiment of the present invention.

Yet another modification is now described. The differential temperature delta Th of FIG. 4 is preferably variable in accordance with a number of outputs to be generated from one image as described below with reference to FIGS. 8 and 9, wherein FIG. 8 illustrates a temperature profile of the surface of the fixing member when an image formation permission temperature T3 is 138 degree centigrade in the 1,200 dpi mode, which is calculated by adding a prescribed differential temperature delta Ts (i.e., 20 degree) to the second target fixing temperature Ts (i.e., 20 degree).

In such a condition, a waiting time taken by the down reload from an image formation available time is about 40 seconds. Specifically, in the example of FIG. 4, a default image formation permission condition (i.e., the image formation permission temperature T3) in the 1,200 dpi mode is 133 degree centigrade, and the waiting time for down reload needs about 90 seconds. However, by increasing the differential temperature delta Ts for the image formation permission condition than the differential temperature delta Th by about 5 degree, a waiting time for an operator can be decreased down to less than half.

Further, it is recognized that temperature of the surface of the fixing member fixing the first passage sheet in the 1,200 dpi mode is 127 degree centigrade when the image formation permission temperature T3 is 133 degree centigrade as shown in FIG. 4. Whereas, it is 132 degree centigrade when a first passage sheet medium passes through the fixing nip with temperature higher by 5 degree when the image formation permission temperature T3 is 138 degree centigrade in FIG. 8.

An exemplary relation between a temperature of a surface of the fixing member and glossiness obtained when later described toner is attracted in a density of 0.8 [mg/cm$^2$] onto a sheet medium P having a thickness of about 74 g/m$^2$ conveyed at a line velocity of about 60 mm/sec in the image forming apparatus 20. The toner can provide high and low levels of glossiness. However, due to having an inflection point at around 130 degree centigrade, glossiness of toner becomes uneven among pages when the surface temperature of the fixing member fluctuates between more or less than 130 degree centigrade during consecutive sheet passages, such as in a sorting mode, etc., in the image forming apparatus 20. Therefore, a glossiness difference occurs between pages.

However, when the image formation permission temperature T3 is 138 degree centigrade as shown in FIG. 8, temperature of the surface of the fixing member fixing the second passage sheet decreases down to about 126 degree centigrade in the 1,200 dpi mode as almost the same as the first passage sheet in the 1,200 dpi when the image formation permission temperature T3 is 133 degree centigrade as shown in FIG. 4. Specifically, only the first passage sheet has a relatively is outputted with the relatively high glossiness image in the image formation permission temperature T3 of 138 degree centigrade. In other words, even though the first passage sheet has relatively high glossiness image, a waiting time before image outputting can be reduced while deemphasizing unevenness of glossiness or a repetitious change in the glossiness generally caused during consecutive printing.

Hence, by increasing the differential temperature delta T when image formation request of less than a prescribed number of output sheets that is capable of avoiding emphasis of the repetitious glossiness changes is made, the down reload time and a waiting time for changing image formation condition can be reduced while saving energy as much as possible. The prescribed number of output sheets may vary in accordance with a fixing condition and a toner type and the like provided in the image forming apparatus 20.

Figure 10:
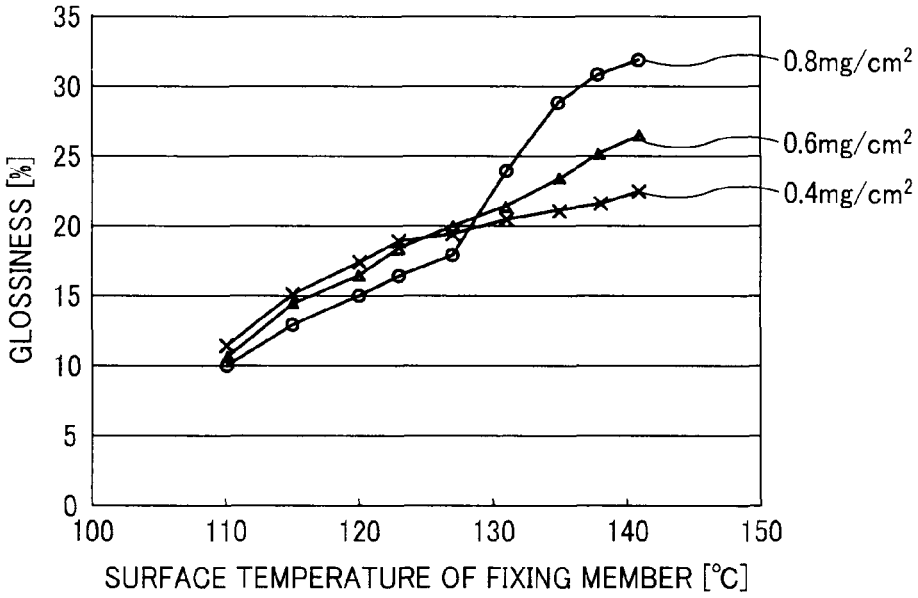
FIG. 10 illustrates an exemplary relation between surface temperature of a fixing member and glossiness per an amount of attracted toner particles in an image forming apparatus according to one embodiment of the present invention.

Yet another modification is now described with reference to FIG. 10, wherein exemplary relations between temperature of a surface of the fixing member and glossiness of toner is described by changing an amount of attracted toner particles onto the sheet medium P.

Specifically, the first relation is obtained by plotting circles on a condition that more than two color toner particles having an amount of 0.8 [mg/cm$^2$] are superimposed onto the sheet medium P as a color image, which prioritizes image quality in the image forming apparatus 20. A second relation is obtained by plotting triangles on a condition that a color image is formed by decreasing an amount of attracted toner particles on the sheet medium P down to about 0.6 [mg/cm$^2$] in a toner save mode, which prioritizes reduction of toner consumption rather than the image quality. A third relation is obtained by plotting christcrosses on a condition that a monochrome image is formed with an upper limit amount of attracted toner particles of 0.4 [mg/cm$^2$] onto the sheet medium P.

In such a situation, the above-described prescribed differential temperature delta Th is preferably variable in accordance with an amount of toner particles attracted onto an image to be outputted.

Specifically, when an amount of toner particles attracted onto the sheet medium P is about 0.4 to 0.6 [mg/cm$^2$] as plotted by triangles and a christcrosses in the drawing and the surface temperature of the fixing member is about 145 degree centigrade, etc., that does not cause curl in the sheet medium P, since a change rate of glossiness with regard to temperature is about 0.5[%/deg] and no inflection point appears as different from the plotting of the circles of the amount of 0.8 [mg/cm$^2$] as shown, an image is preferably formed.

Since information of the maximum attracted amount of toner particles is obtained from image information read by a scanner in a copier mode, or that outputted and transmitted from a personal computer or the like in a printer mode in the image forming apparatus 20, the above-described differential temperature delta Th is preferably simply switched in accordance with the attracted amount information.

Hence, by increasing differential temperature delta Th to be added to a second target fixing temperature T2 while permitting image formation when image formation request is made under a condition in that an amount of attracted toner particles does not emphasize the repetitious glossiness change, the down reload time and a waiting time needed for changing image formation condition can be reduced while saving energy as much as possible.

The image forming apparatus 20 includes a mechanism capable of switching an image formation mode between a full-color mode, a monochrome mode, and a toner save mode or the like. Since the maximum amount of attracted toner particles onto the sheet medium P changes as an image formation mode is switched as described above, the present invention can more effectively be applied to a system especially in which an image formation mode is switched while changing resolution.

The image forming apparatus 20 includes a mechanism capable of switching an image processing mode between a character mode, a photograph mode, and a character and photograph mixture mode or the like. Since the maximum amount of toner particles attracted on the sheet medium P changes as an image formation mode is switched as described above, the present invention can more effectively be applied to a system especially in which an image formation mode is switched while changing resolution.

The above-described line velocity, the target fixing temperature, and the differential temperature are typically employed in the above-described apparatus, and optimum setting values of those can be sought in a different system and condition through an experience in view of a configuration thereof and characteristic of toner employed.

The toner used in this embodiment is excellent in transparency and brightness (i.e., glossiness) and accordingly achieves a high quality image than conventional. The toner is further excellent in a hot offset proof performance, a charging stability, and a transfer performance. The toner relatively slowly melts with heat, because a flowing out start temperature of the toner is about 92±1 degree centigrade slightly greater than the conventional smash type toner of 86±2 degree centigrade. Thus, a first surface is preferably previously heated to uniformly and entirely melt a toner layer, improve smoothness of the surface thereof, and increase glossiness.

Thus, according to one embodiment of the present invention, polyester resin is used as a binder in electro photograph use toner.

Numerous additional modifications and variations of the present invention are possible in latent image of the above-described teachings. It is therefore to be understood that within the scope of the appended claims, the present invention may be practiced otherwise that as specifically described herein.

What is claimed is:

1. An image forming apparatus comprising:

an image formation device to form a toner image to be transferred and fused later onto a recording medium under at least two prescribed different image formation conditions;

a thermal fixing unit including a fixing member heated or cooled to at least two prescribed first and second target fixing temperatures, said second target fixing temperature being lower than the first target fixing temperature and a pressing member pressing against the fixing member to form a fixing nip thereat, said thermal fixing unit fixing the toner image onto a recording medium by conveying the recording medium through the fixing nip; and a controller to permit the image formation device to start image formation all of when the first target fixing temperature is changed to the second target fixing temperature, and when a previous job is completed under a previous image formation condition designated previously and the next job becomes available, and when a prescribed elapsing time has elapsed after the next job becomes available, said prescribed time being determined in accordance with a type of an image to be outputted.

2. The image forming apparatus as claimed in claim 1, wherein said prescribed elapsing time is shorter when the image to be outputted does not need glossiness than when it needs the glossiness.

3. The image forming apparatus as claimed in claim 1, wherein said controller permits the image formation device to start image formation before the prescribed time has elapsed after the image formation becomes available, when one of the at least two image formation conditions is changed to the other, the first target fixing temperature is changed to the second target fixing temperature, and the temperature of the fixing member is equal to or less than a prescribed image formation permissible level higher than the second target fixing temperature by a prescribed adjustment value.

* * * * *